US006752105B2

(12) United States Patent
Gray, Jr.

(10) Patent No.: US 6,752,105 B2
(45) Date of Patent: Jun. 22, 2004

(54) PISTON-IN-PISTON VARIABLE COMPRESSION RATIO ENGINE

(75) Inventor: Charles L. Gray, Jr., Pinckney, MI (US)

(73) Assignee: The United States of America as represented by the Administrator of the United States Environmental Protection Agency, Washington, DC (US)

( * ) Notice: Subject to any disclaimer, the term of this patent is extended or adjusted under 35 U.S.C. 154(b) by 0 days.

(21) Appl. No.: 10/215,820

(22) Filed: Aug. 9, 2002

(65) Prior Publication Data

US 2004/0025814 A1 Feb. 12, 2004

(51) Int. Cl.[7] ..... F02B 75/04
(52) U.S. Cl. ..... 123/48 B; 123/78 BA
(58) Field of Search ..... 123/48 AA, 78 AA, 123/48 B, 78 B, 78 BA, 78 E, 78 F

(56) References Cited

U.S. PATENT DOCUMENTS 1,309,891 A * 7/1919 Griffith ..... 123/48 B
3,014,468 A * 12/1961 Mansfield ..... 123/48 B
3,038,458 A 6/1962 Mansfield ..... 123/78 R
3,656,412 A 4/1972 Wilson ..... 92/82

(List continued on next page.)

FOREIGN PATENT DOCUMENTS

| | | |
|---|---|---|
| EP | 0 289 872 | 11/1988 |
| JP | 59 128949 | 7/1984 |
| JP | 60 081431 | 5/1985 |
| WO | WO 86/01562 | 3/1986 |

OTHER PUBLICATIONS

Basiletti and Blackburne, "Recent Developments in Variable Compression Ratio Engines," Society of Automotive Engineers, Inc., Technical Paper 660344, 1966.

*Primary Examiner*—Willis R. Wolfe
(74) *Attorney, Agent, or Firm*—Seed IP Law Group PLLC

(57) ABSTRACT

An improved apparatus for generating a variable compression ratio within an ICE includes a piston-in-piston assembly having an inner piston that is slidably mounted within an outer piston and coupled to an actuator. The actuator is further coupled to a fluid source, and a volume of fluid is selectively channeled into and out of the actuator to move the inner piston to selected positions corresponding to desired compression ratios. At top dead center, a top face of the outer piston maintains a substantially constant distance from an engine head assembly to minimize squish area variations.

61 Claims, 12 Drawing Sheets

U.S. PATENT DOCUMENTS

| | | | | | |
|---|---|---|---|---|---|
| 3,741,175 | A | | 6/1973 | Rouger | 123/48 A |
| 4,016,841 | A | * | 4/1977 | Karaba et al. | 123/78 B |
| 4,077,269 | A | | 3/1978 | Hodgkinson | 74/60 |
| 4,144,851 | A | | 3/1979 | Prosen | 123/78 C |
| 4,148,284 | A | | 4/1979 | Prosen | 123/78 C |
| 4,449,489 | A | | 5/1984 | Williams | 123/48 R |
| 4,469,055 | A | | 9/1984 | Caswell | 123/78 B |
| 4,485,768 | A | | 12/1984 | Heniges | 123/48 B |
| 4,503,815 | A | | 3/1985 | Amm | 123/48 A |
| 4,510,895 | A | * | 4/1985 | Slee | 123/48 B |
| 4,602,596 | A | * | 7/1986 | Kessler | 123/78 BA |
| 4,753,198 | A | | 6/1988 | Heath | 123/51 AA |
| 4,821,695 | A | | 4/1989 | Freudenstein | 123/197.4 |
| 4,860,711 | A | | 8/1989 | Morikawa | 123/48 D |
| 4,864,977 | A | * | 9/1989 | Hasegawa | 123/48 B |
| 4,876,992 | A | | 10/1989 | Sobotowski | 123/48 R |
| 4,917,066 | A | | 4/1990 | Freudenstein et al. | 123/48 B |
| 4,987,863 | A | | 1/1991 | Daly | 23/48 AA |
| 5,146,879 | A | | 9/1992 | Kume et al. | 123/48 B |
| 5,178,103 | A | | 1/1993 | Simko | 123/48 B |
| 5,257,600 | A | | 11/1993 | Schechter et al. | 123/78 B |
| 5,331,928 | A | | 7/1994 | Wood | 123/78 B |
| 5,427,063 | A | | 6/1995 | Anderson | 123/48 A |
| 5,507,253 | A | | 4/1996 | Lowi, Jr. | 123/56.9 |
| 5,549,087 | A | | 8/1996 | Gray, Jr. et al. | 123/254 |
| 5,562,079 | A | | 10/1996 | Gray, Jr. | 123/276 |
| 5,579,640 | A | | 12/1996 | Gray, Jr. et al. | 60/413 |
| 5,609,131 | A | | 3/1997 | Gray, Jr. et al. | 123/299 |
| 5,611,300 | A | | 3/1997 | Gray, Jr. | 123/48 A |
| 5,617,823 | A | | 4/1997 | Gray, Jr. et al. | 123/254 |
| 5,638,777 | A | | 6/1997 | Van Avermaete | 123/52.4 |
| 5,682,854 | A | | 11/1997 | Ozawa | 123/316 |
| 5,791,302 | A | | 8/1998 | Ma | 123/48 B |
| 5,865,092 | A | * | 2/1999 | Woundwyk | 123/78 E |
| 5,908,012 | A | * | 6/1999 | Endoh | 123/48 B |
| 5,908,014 | A | | 6/1999 | Leithinger | 123/78 F |
| 5,934,228 | A | | 8/1999 | Wheat | 123/48 C |
| 6,135,086 | A | | 10/2000 | Clarke et al. | 123/316 |
| 6,167,851 | B1 | | 1/2001 | Bowling | 123/48 B |
| 6,170,524 | B1 | | 1/2001 | Gray, Jr. | 137/625.18 |
| 6,186,126 | B1 | | 2/2001 | Gray, Jr. | 123/557 |
| 6,189,493 | B1 | | 2/2001 | Gray, Jr. | 123/52.4 |
| 6,202,416 | B1 | | 3/2001 | Gray, Jr. | 60/620 |
| 6,216,462 | B1 | | 4/2001 | Gray, Jr. | 60/616 |
| 6,301,888 | B1 | | 10/2001 | Gray, Jr. | 60/605.2 |
| 6,301,891 | B2 | | 10/2001 | Gray, Jr. | 60/616 |
| 6,415,607 | B1 | | 7/2002 | Gray, Jr. | 60/616 |

* cited by examiner

PISTON-IN-PISTON VARIABLE COMPRESSION RATIO ENGINE

BACKGROUND OF THE INVENTION

1. Field of the Invention

The present invention relates generally to an apparatus for generating a variable compression ratio in an internal combustion engine, including an apparatus wherein an inner piston is selectively movable within an outer piston.

2. Description of the Related Art

In automotive powertrain designs that currently prevail, an internal combustion engine (ICE) is employed as the source of motive power. ICEs create mechanical work from fuel energy by combusting the fuel over a thermodynamic cycle. Although the demands of normal driving call for a wide range of power demands and speeds, the best energy conversion efficiency of an ICE is experienced over only a relatively narrow range of loads and speeds.

ICEs sized and calibrated to generate the high power levels required to meet intermittent demands (such as rapid acceleration, passing, and hill climbing) operate inefficiently at low to moderate power levels the vast majority of the time. This is largely because, with conventional technology, the compression ratio cannot be calibrated and is therefore pre-set to a level that will allow the ICE to meet intermittent power demands, as opposed to a level that will optimize engine efficiency during normal operating loads.

Compression ratio is the ratio of expanded cylinder volume to compressed cylinder volume in one cycle of a reciprocating piston within an ICE. According to thermodynamic laws, a greater degree of compression relative to the expanded volume corresponds to greater efficiency of the thermodynamic cycle and hence greater efficiency of the engine. An ICE with a higher compression ratio is therefore better able to convert fuel energy to mechanical work than an ICE with a lower compression ratio. Unfortunately, a high compression ratio may result in several undesirable side effects. An increased level of friction and higher peak cylinder pressures are two results of a high compression ratio. Under these conditions, if the fuel is introduced with a fresh charge of air, there is a potential for knocking or pre-ignition at high power output.

For this reason, with conventional engine hardware, if the compression ratio were simply pre-set to a high level in order to maximize engine efficiency at normal loads, the operation of the ICE at the maximum power demand levels would lead to severe knocking, reduced engine efficiency, and potential engine damage.

These problems could be avoided if the compression ratio of an ICE could be calibrated. Ideally, one would desire to employ a high compression ratio at normal loads, and shift to a lower compression ratio for intermittent high loads. In this way, the high efficiency associated with a high compression ratio could be achieved over normal ranges of operation, while higher power output could be achieved without fear of pre-ignition by invoking a lower compression ratio.

Various methods are currently known to vary the compression ratio of an ICE. However, as testified to by the lack of variable compression ratio engines in automotive applications, none of these known designs have proven to be sufficiently effective or practical to warrant widespread use in automotive applications. Applicant therefore believes it is desirable and possible to provide an improved system for generating a variable compression ratio engine. The present invention provides such a system.

BRIEF SUMMARY OF THE INVENTION

Briefly, the present invention provides an improved system for generating a variable compression ratio within an ICE. The engine may therefore operate at more than one distinct compression ratio, selectable during engine operation. As a result, an engine provided in accordance with the present invention operates near its most efficient operating range during the majority of driving, while providing intermittent high power capability in a way that does not lead to undesirable side effects. (While the invention is described herein as used in an automotive ICE, it will be understood that the present invention may be used in any ICE.)

More particularly, in a preferred embodiment of the present invention, a piston assembly for an ICE has an inner piston slidably mounted within an outer piston. The outer piston is mounted in a cylinder of an ICE to reciprocate in a conventional manner. During operating conditions of low to moderate power demands, the top of the inner piston is flush with the top of the outer piston, defining a high compression ratio mode. The relatively high compression ratio in this mode provides improved thermodynamic efficiency in this operating range. When power demand increases to the point where this high compression ratio might cause performance problems such as pre-ignition or knocking, a command signal causes the inner piston to recede to a second position within the outer piston, thereby reducing the compression ratio. Good mixing and combustion is retained in both modes because the piston bowl resides within the receding inner piston and therefore does not change shape, only changing its relative distance from the top of the cylinder when at top dead center (TDC).

In a preferred embodiment, the inner piston is located in either the normal high compression ratio position or the intermittent low compression ratio position by the rotation of a rotary cam-like actuator which pivots about a wrist pin residing in the outer piston. (It will be understood that while the present invention has been described in the context of an application where a higher compression ratio is the predominant mode of operation and a low compression ratio is only used intermittently, the present invention may provide an engine where the default mode of operation is at a low compression ratio and a high compression ratio is used intermittently.) In one preferred embodiment, the actuator is comprised of a rotary hydraulic piston within a hydraulic chamber that is integrated with the wrist pin, and a cam which pivots around the wrist pin in reaction to movement of the hydraulic piston. Movement of the rotary hydraulic piston and cam assembly is caused by the presence or absence of pressurized fluid in the hydraulic chamber, in conjunction with inertial forces created by reciprocation of the piston assembly in an engine cylinder. The pressurized fluid is directed into and out of the hydraulic chamber by a control system that generates appropriate command signals. Additional embodiments vary the actuation means to include additional springs and/or hydraulic systems.

BRIEF DESCRIPTION OF THE SEVERAL VIEWS OF THE DRAWING

In the drawings, the sizes and relative positions of elements are not necessarily drawn to scale. For example, the shapes of various elements and angles are not drawn to scale, and some of these elements are arbitrarily enlarged and positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with ICEs have not been shown or described in detail to avoid unnecessarily obscuring descriptions of the embodiments of the invention. Also, while the present invention is described herein, for ease of discussion, as having a vertical orientation, it should be understood that the present invention may be installed and operated within an ICE at a number of different angles.

In general, the present invention achieves a selectively variable compression ratio in ICEs through the use of a piston assembly 10 where an inner piston 11 is slidably mounted within an outer piston 12 to vary the compression ratio. By raising and lowering the inner piston 11 to raise and lower the compression ratio of an ICE, this invention provides a useful and robust means with which to maximize engine efficiency.

Figure 1:
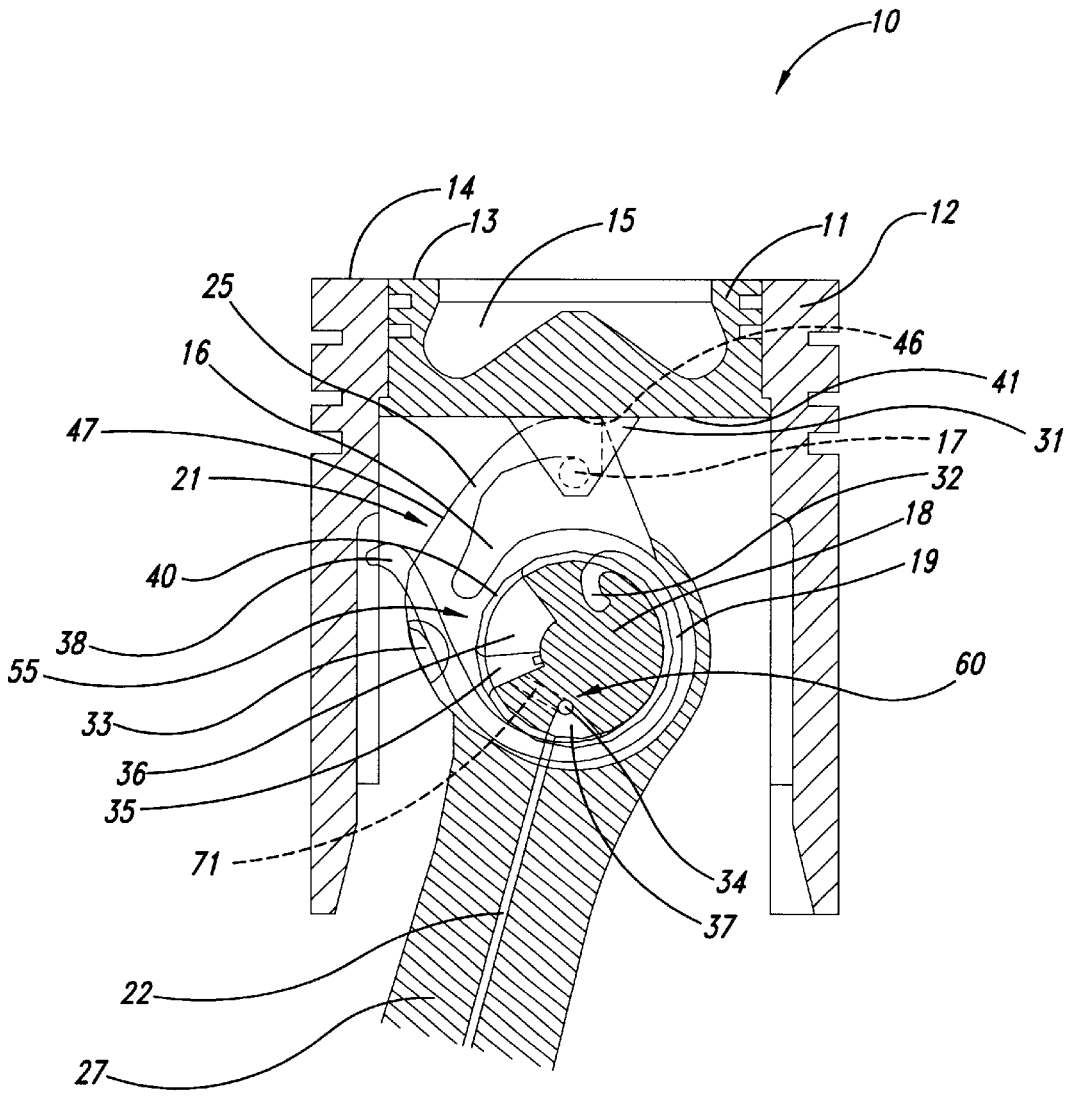
FIG. 1 is a partial cross-sectional view of a piston assembly, provided in accordance with a preferred embodiment of the present invention, illustrated in a high compression ratio mode.
Figure 2:
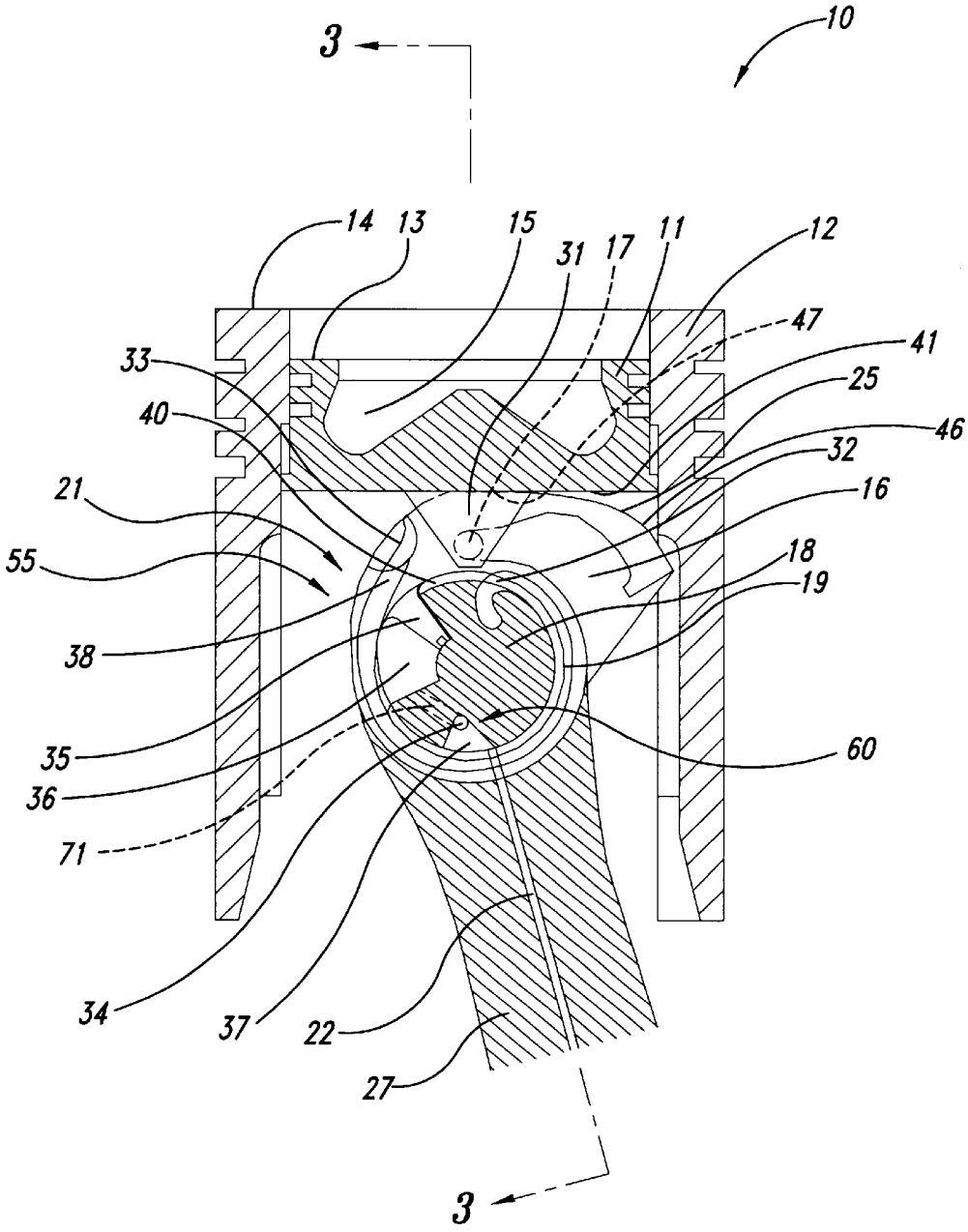
FIG. 2 is a partial cross-sectional view of the piston assembly of FIG. 1, illustrated in a low compression ratio mode.

For example, as shown in FIG. 1, the inner piston 11 can be selectively positioned so that a top surface of the inner piston 13 is substantially adjacent to a top surface of the outer piston 14 to produce a high compression ratio. As shown in FIG. 2, the inner piston can also be selectively dropped to a position where the top surface of the inner piston 13 is lower than the top surface of the outer piston 14 to produce, upon demand, a lower compression ratio. Movement of the inner piston is caused by the rotation of an actuator assembly 55 consisting of a cam assembly 21 which pivots about a wrist pin 18 residing in the outer piston 14.

In an engine cylinder, the high position shown in FIG. 1 yields a greater degree of compression relative to expanded volume as compared to when the inner piston 11 is selectively positioned lower within the outer piston 12, as shown in FIG. 2. Since greater engine efficiencies at normal operating loads can be achieved when the fuel or air/fuel mixture within a cylinder is compressed to a greater degree, operation of an ICE in this high compression ratio mode can result in improved fuel economy.

According to the principles of the present invention, the inner and outer pistons 11, 12 are coupled to a connecting rod 27 in an identical manner for each of the preferred embodiments discussed herein.

Figure 7:
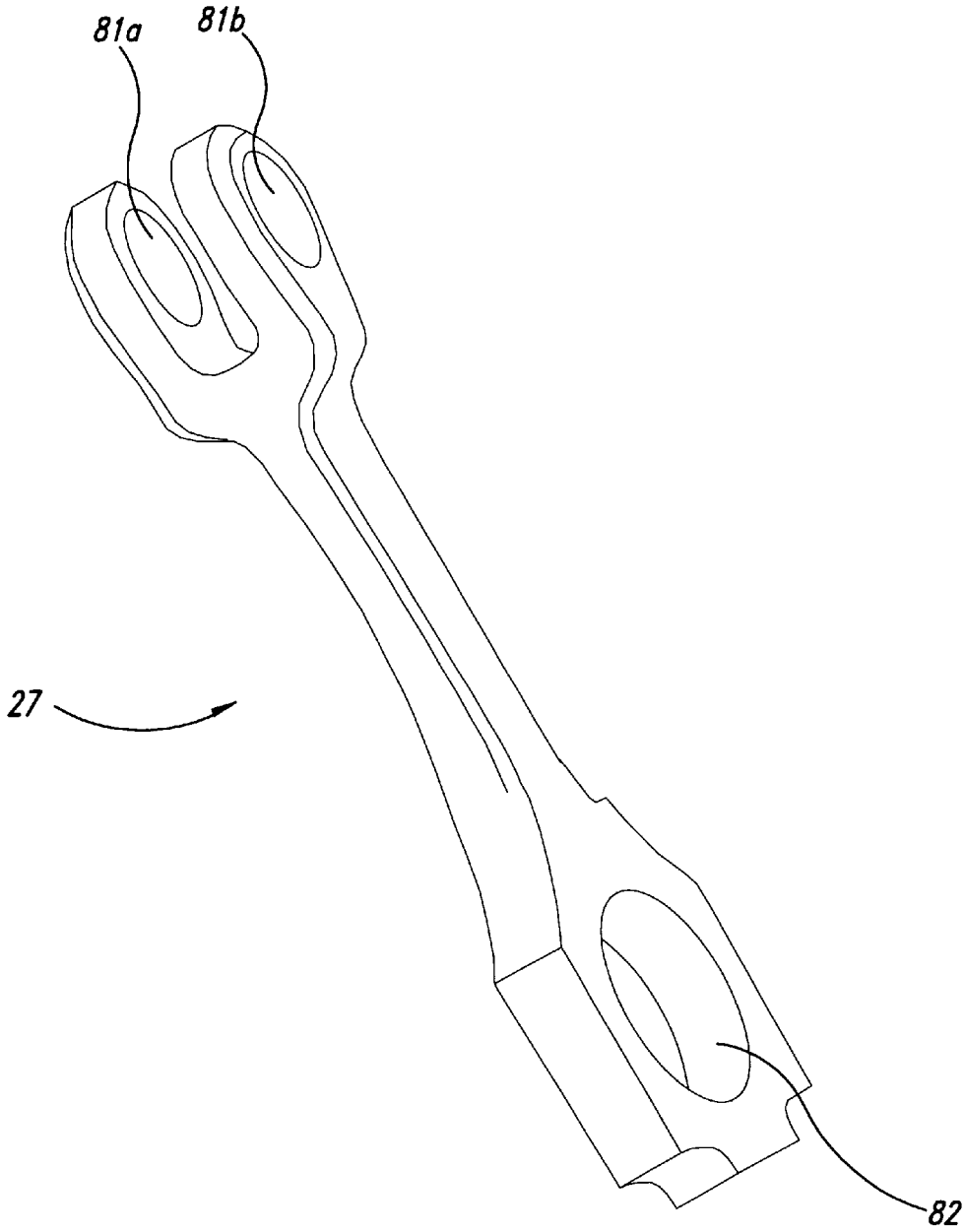
FIG. 7 is an isometric view of a connecting rod provided in accordance with the present invention.

Similar to the assembly of most conventional ICEs, the outer piston 12 of the present invention is rigidly embedded to a wrist pin 18, and a connecting rod 27 pivotably engages the wrist pin 18. FIG. 7 depicts an enlarged view of the connecting rod 27 showing wrist pin bearing surfaces 81*a* and 81*b* that pivotably engage the wrist pin 18, while a crankshaft bearing surface 82 pivotably engages a crankshaft (not shown).

Figure 4:
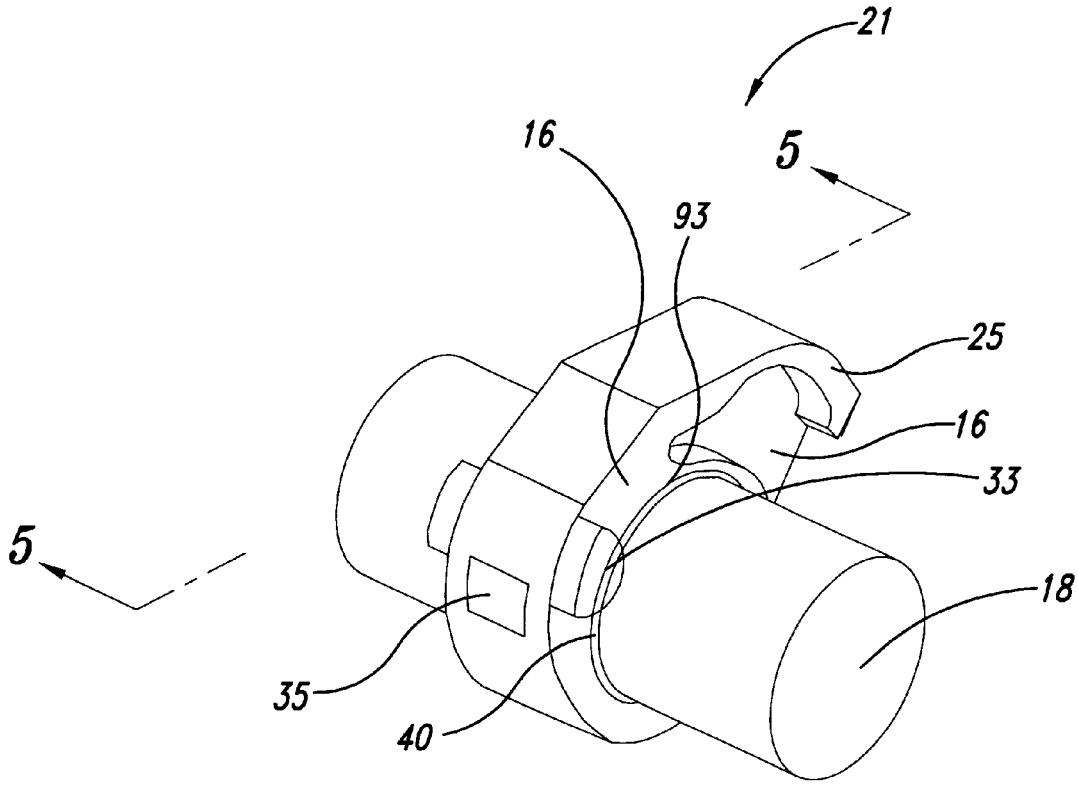
FIG. 4 is an isometric view of a wrist pin and cam assembly of the piston assembly of FIG. 1.

As shown in FIGS. 1, 2 and 4, a cam assembly 21 including a cam 16 is pivotably mounted on the wrist pin 18. A cam bearing sleeve 40 is interposed between the cam 16 and the wrist pin 18, providing a bearing surface 93 between the cam bearing sleeve 40 and the cam 16.

Figure 3:
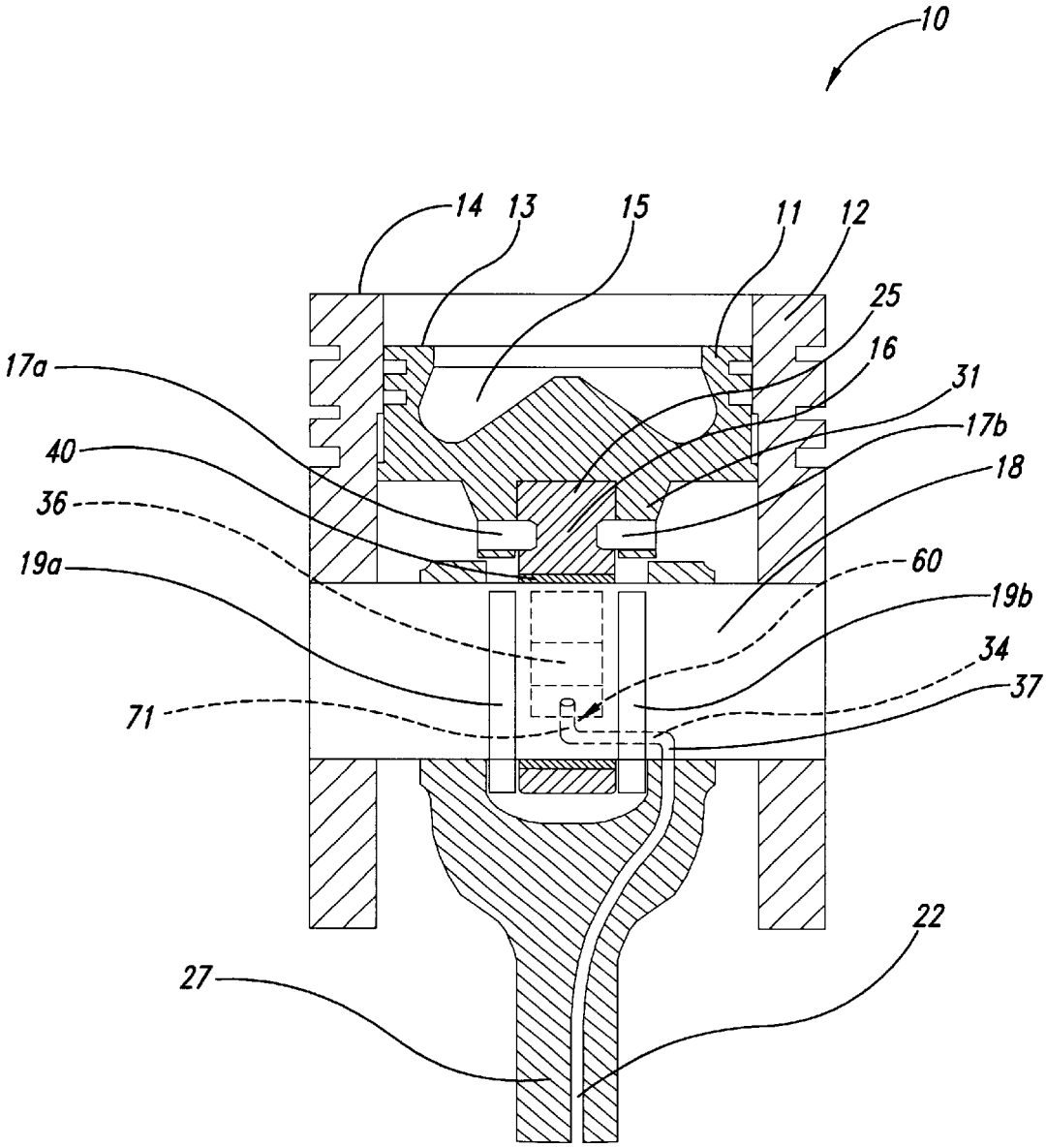
FIG. 3 is a partial cross-sectional view taken along line 3—3 of FIG. 2.

As shown in FIGS. 1 and 2, the inner piston 11 is coupled to the cam 16 via a pin boss 31 and a retaining pin 17. The pin boss 31 may be affixed to the bottom surface 41 of the inner piston 11, or it may be integral to the inner piston 11. As shown in FIG. 3, the retaining pin may alternatively be provided as a pair of retaining pins 17*a* and 17*b* coupled to the cam 16 to engage the inner piston 11 via the pin boss 31.

Discussed now are various embodiments in which the principles of the present invention may be employed. It is to be understood that the term "high compression ratio mode" refers to a compression ratio that is higher than the compression ratio of a same mounted piston assembly 10 in a low compression ratio mode, and one skilled in the art will recognize that the resulting numerical compression ratio difference between operating in a first position and a second position, as well as the range of distances in which the inner piston may be lowered within an outer piston is a matter of design choice, where the tradeoffs between engine efficiency and engine performance must be considered. Further factors influencing the design choice include the ICEs cylinder diameter, connecting rod length, cylinder head and valve design.

In a preferred embodiment, the piston assembly 10 operates intermittently. To achieve the goal of improved engine efficiency, the piston assembly 10 operates in a first position/high compression mode under normal road loads. When a sensor determines that the compression ratio should be reduced, for example, if the demand for power is increasing peak cylinder pressures to the detriment of the ICE's performance, the compression ratio is lowered by moving the inner piston 11 to a position lower than the outer piston 12. In a low compression mode, the top face of the inner piston 13 is positioned lower than the top face of the outer piston 14. Similarly, when a return to normal road load conditions is detected, the inner piston 11 is returned to the first position.

FIG. 1 shows the piston assembly 10 in a first position. The inner piston 11 is slidably mounted within an outer piston 12. The high compression ratio mode is achieved when the top face of the inner piston 13 is substantially flush with the top face of the outer piston 14. As the piston assembly 10 reciprocates within an engine cylinder, the assembly 10 remains in this position as long as no force acts to rotate the cam 16 about the wrist pin 18. Even if inertial forces on a rapidly reciprocating cam assembly 21 do exert a rotational tendency on the cam 16, a spring 19 exerts force on the cam 16 sufficient to counteract this force and the cam 16 remains stable and maintains the high compression ratio mode.

In this preferred embodiment, the cam assembly 21 comprises a cam 16, and a flange 25 having a first flat portion 46 and a second flat portion 47. When in the first position, a bottom surface 41 of the inner piston 11 rests on the first flat portion 46, and the flange 25 eccentrically engages a retaining pin 17 to maintain the high compression ratio mode. The cam 16 is held by the force of a retention spring, which, in the present embodiment, is a clock spring 19 with a fixed end 32 embedded in, or otherwise affixed to, the wrist pin 18. The clock spring 39 also has a free end 38, which is slidably cradled by a spring cradle 33 mounted upon or integral with the cam 16. In an alternate embodiment, shown in FIG. 3, the spring may also consist of a pair of clock springs, 19*a* and 19*b*, to provide symmetry of force.

The second position of the present embodiment is shown in FIG. 2. The inner piston 11 is receded downward within the outer piston 12 so that the top surface of the inner piston 13 is below the top surface of the outer piston 14. The bottom surface 41 of the inner piston 11 rests stably on a second flat portion 47 of the cam 16, with the cam 16 again restrained by the retaining pin 17.

As the inner piston 11 is moved from the first position to the second position, good mixing and combustion is retained in both the high and low compression ratio modes because a piston bowl 15 resides within the moving inner piston 11 and therefore does not change shape, only changing its relative distance from the top of the cylinder when at TDC. Since the shape of the piston bowl 15 is unchanged as the inner piston 11 moves, a further advantage of the present invention, applicable to all of the embodiments discussed herein, is that changes in the charge-mixing and combustion properties of the combustion chamber are minimized.

Figure 5:
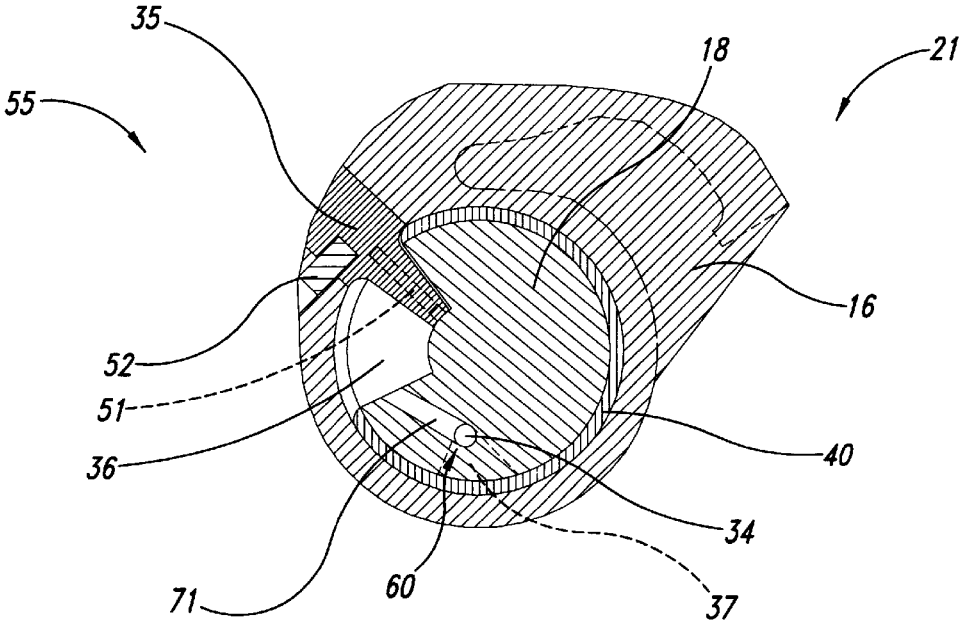
FIG. 5 is a cross-sectional side view taken along line 5—5 of FIG. 4.
Figure 6:
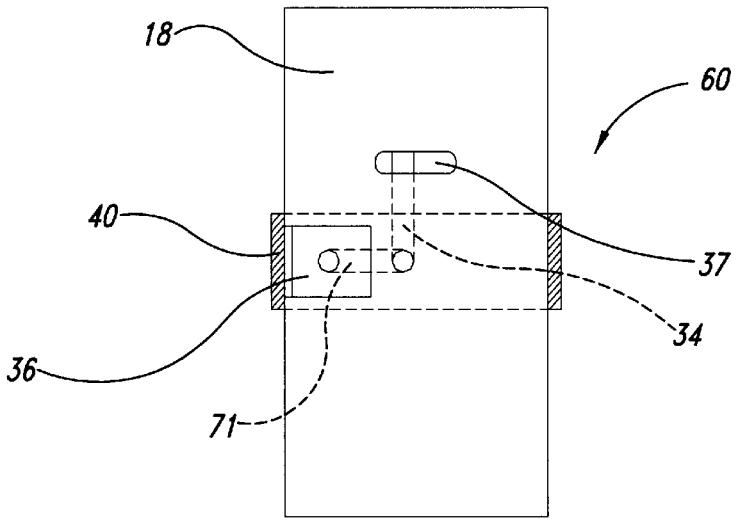
FIG. 6 is a partial bottom orthogonal view of FIG. 5 with parts removed to detail a fluid delivery system of the piston assembly of FIG. 1.

As shown in FIGS. 5 and 6, an actuator assembly 55 is coupled to a fluid delivery system 60 to move the inner piston 11. The actuator assembly 55 comprises the cam assembly 21, the spring 19, and rotary hydraulic chamber 36 having a rotary hydraulic piston 35. In a preferred embodiment, the wrist pin 18 and rotary hydraulic chamber 36 are integral to each other. FIG. 5 shows that the cam 16 houses the rotary hydraulic piston 35 which extends through the cam bearing sleeve 40 and into the rotary hydraulic chamber 36 that is provided in the wrist pin 18. The rotary hydraulic piston 35 is affixed within the cam 16 by means of pin 52 which may employ a threaded, press fit, or other mode of connection. A piston seal 51 of elastomer or similar material is provided on the bearing surface of the rotary hydraulic piston 35 to prevent fluid that enters and exits the hydraulic chamber 36 from leaking past the rotary hydraulic piston 35.

Movement of the actuator assembly 55 is caused by the delivery of a volume of fluid, at a pressure of several bar or more, from a fluid source (not shown) coupled to a bore 22 provided in the connecting rod 27. In a preferred embodiment, the pressurized fluid is engine oil, however, it is to be understood that various hydraulic fluids, as known to one skilled in the art, may also be employed.

In a preferred embodiment for delivering the fluid to the actuator assembly 55, a fluid delivery system 60 is coupled to the fluid source and comprises the connecting rod bore 22, a fluid supply passage 34, a fluid entry port 37, and an internal radial passage 71 within the wrist pin 18. The fluid passage 34 exits at an angle perpendicular to the fluid entry port 37 and proceeds parallel to the wrist pin 18 until it turns into radial passage 71, to enter the rotary hydraulic chamber 36. This arrangement is shown in FIGS. 3 and 6.

As the piston assembly 10 reciprocates within an engine cylinder, fluid communication between the connecting rod bore 22 and the rotary actuator chamber 36 is preferably maintained even as the angle of the connecting rod 27 about the wrist pin 18 varies by perhaps twenty degrees or more. Comparing FIGS. 1 and 2, which depict the angle of the connecting rod 27 at its two extremes, it may be seen that the bearing side of the fluid entry port 37 has a sufficient width to maintain fluid communication with the connecting rod bore 22 as the connecting rod 27 rotates about the wrist pin 18. This arrangement is also shown in FIG. 6.

Returning to the present embodiment for actuating the inner piston 11, fluid via the fluid delivery system 60 enters the rotary hydraulic chamber 36, displacing the rotary hydraulic piston 35, causing the cam 16 to overcome the biasing force of the spring 19 and rotate the cam assembly 21. Owing to the eccentric radius of the inner surface of the flange 25 about the centerline of the wrist pin 18, and the engagement of the flange 25 with the retaining pin 17, a vertical displacement of the inner piston 11 with respect to the outer piston 12 results from the rotation of the cam 16. This low compression ratio mode is maintained as long as sufficient fluid remains in the rotary hydraulic chamber 36 to maintain the position of the displaced hydraulic piston 35.

A volume of fluid to activate the low compression ratio mode is delivered in response to a control signal generated by a control system designed to monitor the operating conditions within an ICE. Preferably, the control system is comprised of a central processing unit and one or more valves for regulating the pressurized fluid pulse.

In one preferred embodiment, the control system monitors the power demanded by the operator of the engine. In a vehicle application, for example, if the accelerator pedal is depressed to a position corresponding to a power demand level likely to raise peak cylinder pressures to a detrimental level, a first command signal is sent and a control valve is opened. Pressurized fluid is conducted from the fluid source into fluid passages provided within the crankshaft and into a bearing interface port provided in the crankshaft bearing surface 82 between the crankshaft and the connecting rod 27. (This method of supplying fluid to a connecting rod through a bearing interface port in a crankshaft/connecting-rod bearing is known in the prior art and is not detailed here.)

After entering the connecting rod 27, fluid proceeds through the connecting rod bore 22, the fluid entry port 37, and fluid supply passage 34 into the rotary hydraulic chamber 36. The chamber 36 quickly becomes filled with pressurized fluid and the rotary hydraulic piston 35 becomes fully displaced. If the piston assembly 10 is installed in an ICE having a closed bearing system, the valve may be closed at this point, as fluid within the hydraulic chamber 36 will remain contained within chamber 36 until a command is given to release the fluid. If however, the piston assembly 10 is installed in an ICE having an open bearing system design, as is the case with most conventional engines having journal bearings, the valve remains open and continues to supply fluid to the rotary hydraulic chamber 36, thereby maintaining the displacement of the hydraulic piston 35 and, in turn, the low compression ratio mode.

As driving conditions change, and the need for more power is no longer required, the accelerator pedal will return from the depressed position, and a second command signal is sent to either re-open the digital valve if it was previously closed, or to cease the continuous supply of fluid, depending again on the ICE's bearing system. This second signal allows the fluid held in the rotary hydraulic chamber 36 to empty via a return path through the passages by which it entered, or to a low-pressure sink. As fluid begins to exit, the force of the spring 19 once again is sufficient to counteract the force of the fluid, and causes the cam 16 to rotate sufficiently that the bottom surface 41 of the inner piston 11 no longer rests on the second flat portion 47 of the cam 16. Inertial forces acting on the reciprocating piston assembly exert an additional lifting force on the inner piston 11, thus supplementing the force of the spring 19 in causing the cam 16 to rotate back into a high compression ratio mode. Resting again on the first flat portion 46 of the cam 16, and additionally restrained by the retaining pin 17, the inner piston 11 is once again in the stable first position shown in FIG. 1.

In an ICE with multiple cylinders, a command signal may be provided to each piston assembly within each cylinder, or to a subgroup of piston assemblies 10. In this way, the timing used to vary the compression ratio may be further tuned to optimize engine efficiency and performance.

In another preferred embodiment, the control system monitors the cylinder pressure to determine when a signal should be sent to vary the compression ratio. As with the previous embodiment, when the cylinder pressure is at an undesirable level, a first signal is sent to lower the inner piston 11. When the cylinder pressure returns to a level where the compression ratio may be maximized without compromising performance, a second signal is sent to raise the inner piston 11. It is to be understood by one skilled in the art, that there are numerous other means in which a control system can monitor the operating conditions within an ICE and the invention is not limited to those discussed herein.

Figure 8:
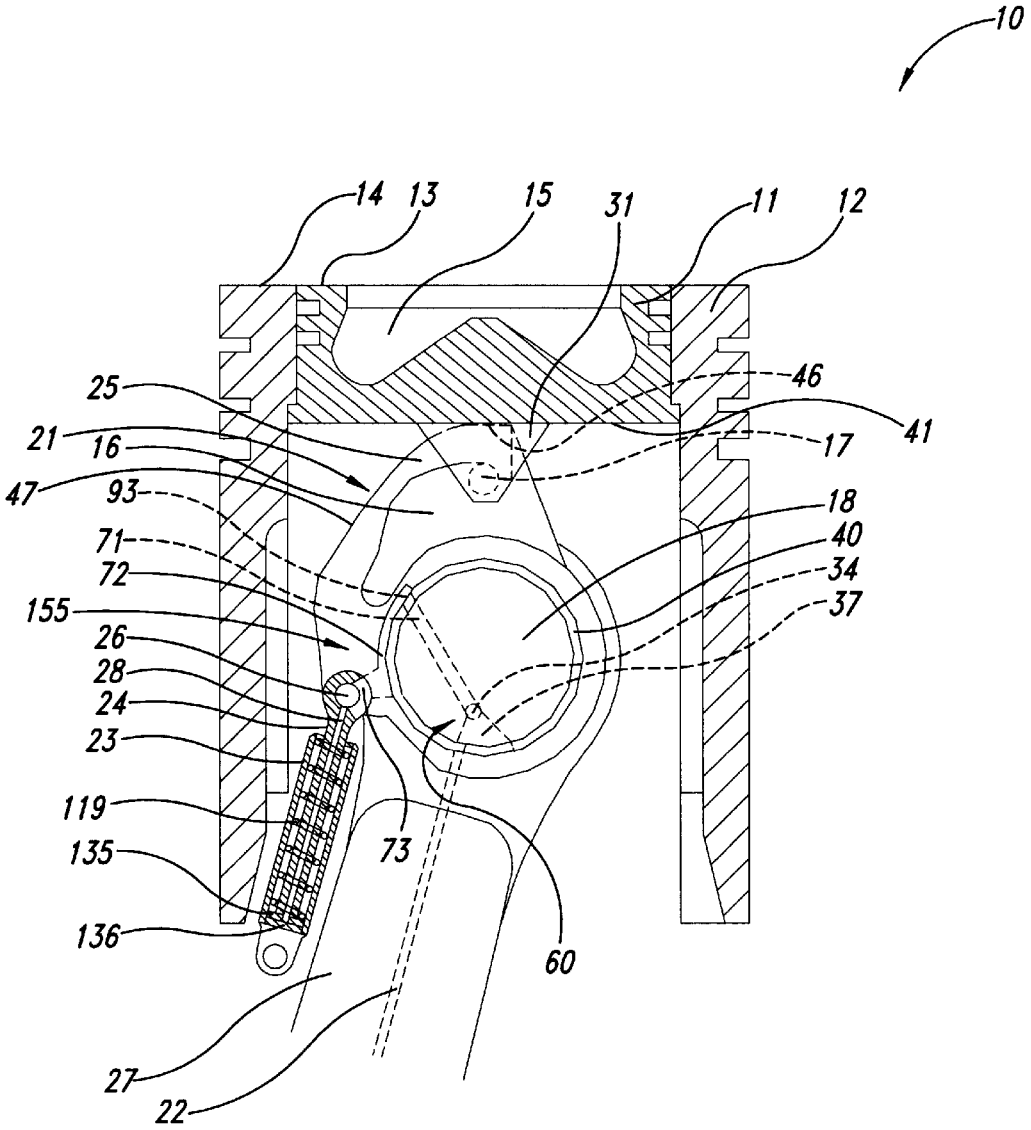
FIG. 8 is a partial cross-sectional view of a piston assembly for generating a variable compression ratio provided in accordance with another preferred embodiment of the present invention, illustrated in a high compression ratio mode.
Figure 10:
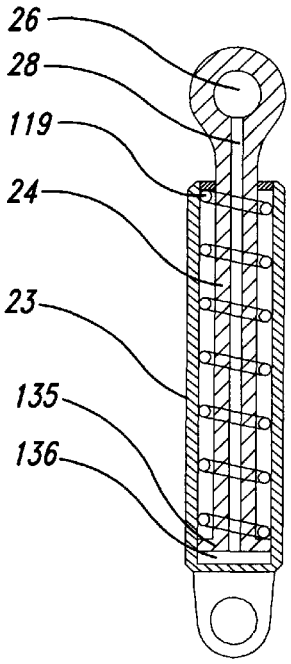
FIGS. 10 and 11 provide an enlarged cross-sectional view of an actuator of the piston assembly of FIG. 8, viewed in a first and a second position, respectively.
Figure 11:
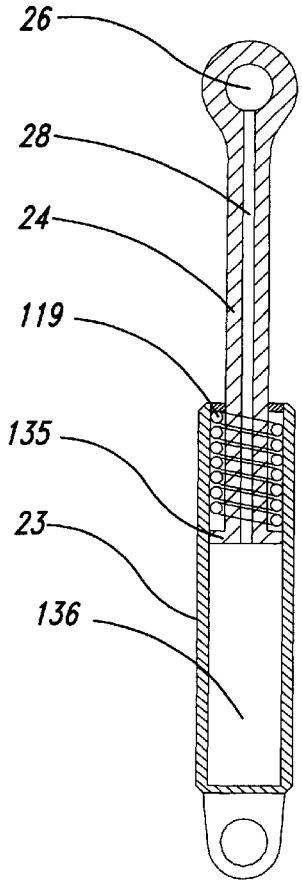

Another preferred embodiment for actuating the inner piston is shown in FIG. 8. Actuation of the inner piston 11 from a first position to a second position is similar to the previous embodiment discussed according to FIGS. 1 and 2; however, the actuator assembly 155 provides a coil spring 119 within a control cylinder 23 in contrast to the clock spring 19 of the previous embodiment. Also, as opposed to the rotary hydraulic chamber 36 of the previous embodiment, here, the control cylinder 23 comprises a hydraulic chamber 136 externally coupled to the wrist pin 18. As best seen in FIGS. 10 and 11, a plunger-type hydraulic piston 135 is positioned in hydraulic chamber 136. A longitudinal bore 28 is provided in stem 24, creating a path of fluid communication between stem port 73 and chamber 136.

The fluid delivery system 60 of the present embodiment for actuating the inner piston is also similar to the previously described embodiment. Further, a bearing surface 93 is coupled to the internal radial passage 71 and to a cam bearing surface passage 72 which is in open communication with the stem bore 28. In this embodiment, the cam assembly 21, the coil spring 119, the hydraulic chamber 136, and the plunger type hydraulic piston 135 comprise an actuator assembly 155.

Figure 9:
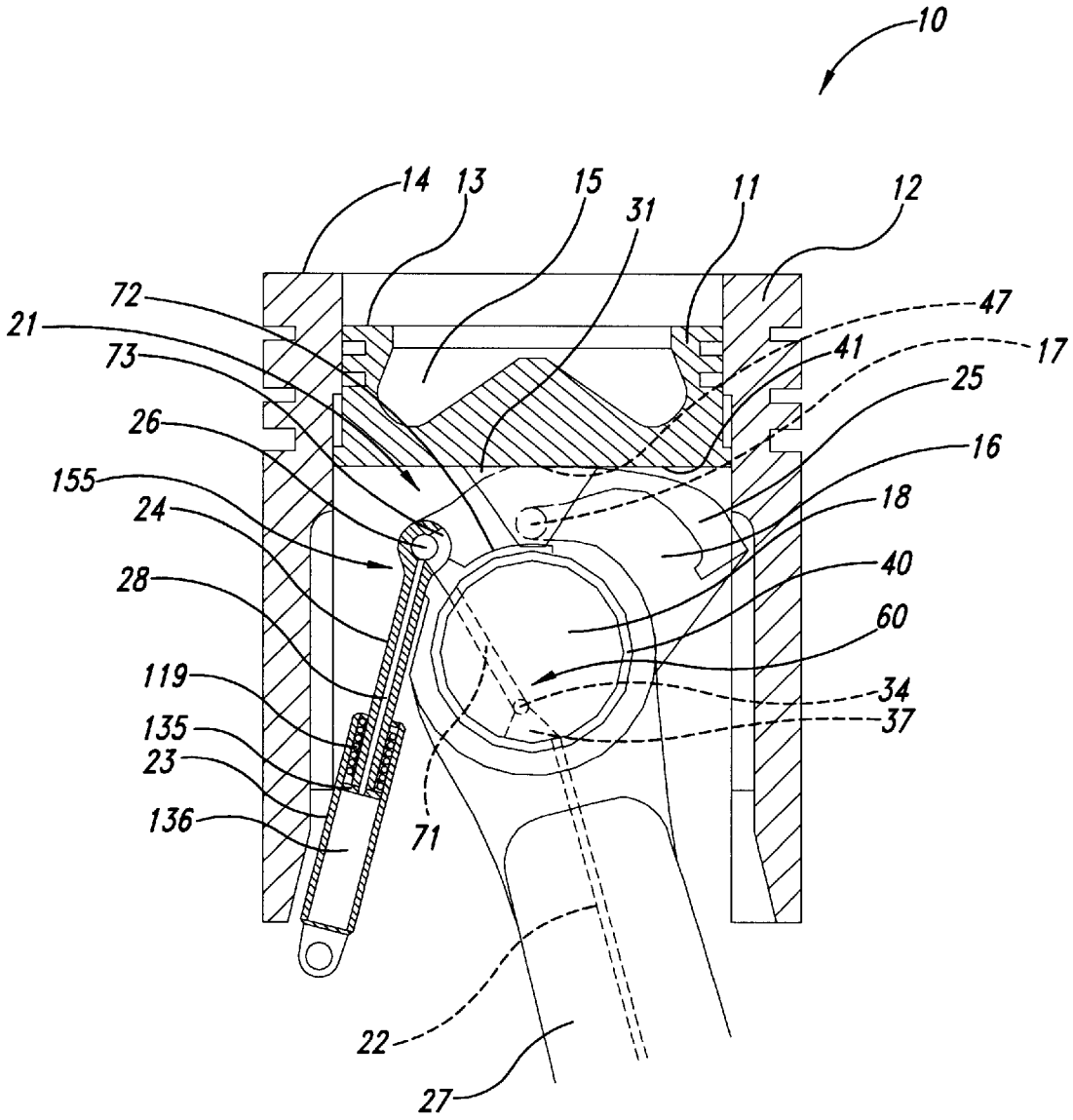
FIG. 9 is a partial cross-sectional view of the piston assembly of FIG. 8, illustrated in a low compression ratio mode.

With actuator assembly 155, the low compression mode shown in FIG. 9 is achieved via a command signal that is issued in a similar fashion to that described for FIG. 2. Issuance of the control signal causes fluid to fill the hydraulic chamber 136 resulting in a displacement of the hydraulic piston 135, stem 24, and pivot 26, which results in a rotation of the cam 16 to lower the inner piston 11 to a stable low compression ratio mode. As in the previously described embodiment, release of fluid from the cylinder chamber 44 in a reverse manner allows the restorative force of the coil spring 119 to initiate a return to a high compression ratio mode. This process is assisted, as before, by inertial forces, until the stable first position shown in FIG. 8 is restored.

Each of the embodiments described herein moves the inner piston 11 quickly, in response to the command signals. This ability to quickly vary the compression ratio is a further advantage of the present invention over known prior art. When an ICE is calibrated to operate at a high compression ratio during normal loads, the demand for further power output can result in excessive peak cylinder pressures. The detrimental effects associated with such pressure increases may be minimized by lowering the compression ratio to timely provide additional space in the combustion chamber.

Although specific embodiments for actuating the inner piston are discussed herein, it is to be understood by one skilled in the art that there are a number of ways in which a first member slidably mounted within a second member may be actuated, and the means of actuating the inner piston 11 relative to the outer piston 12 is not to be limited to those discussed herein. As will be understood by one of ordinary skill, there a number of ways to channel fluid from a fluid source to the piston and cylinder region of an ICE, and the fluid delivery system 60 described herein is not to limit the scope of this invention.

Figure 12:
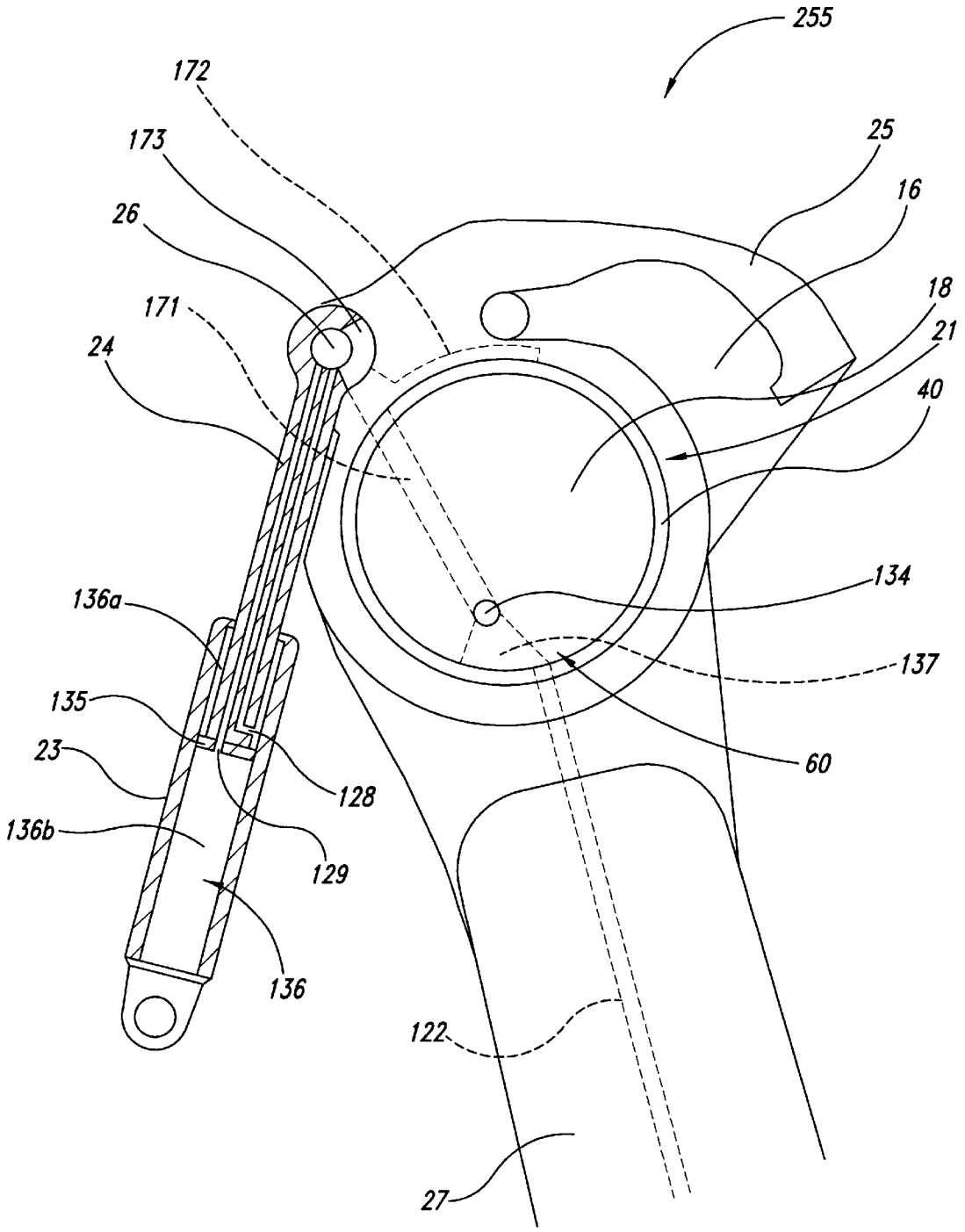
FIG. 12 is a partial cross-sectional view of an actuator assembly provided in accordance with yet another preferred embodiment of the present invention, illustrated in a low compression ratio mode.
Figure 13:
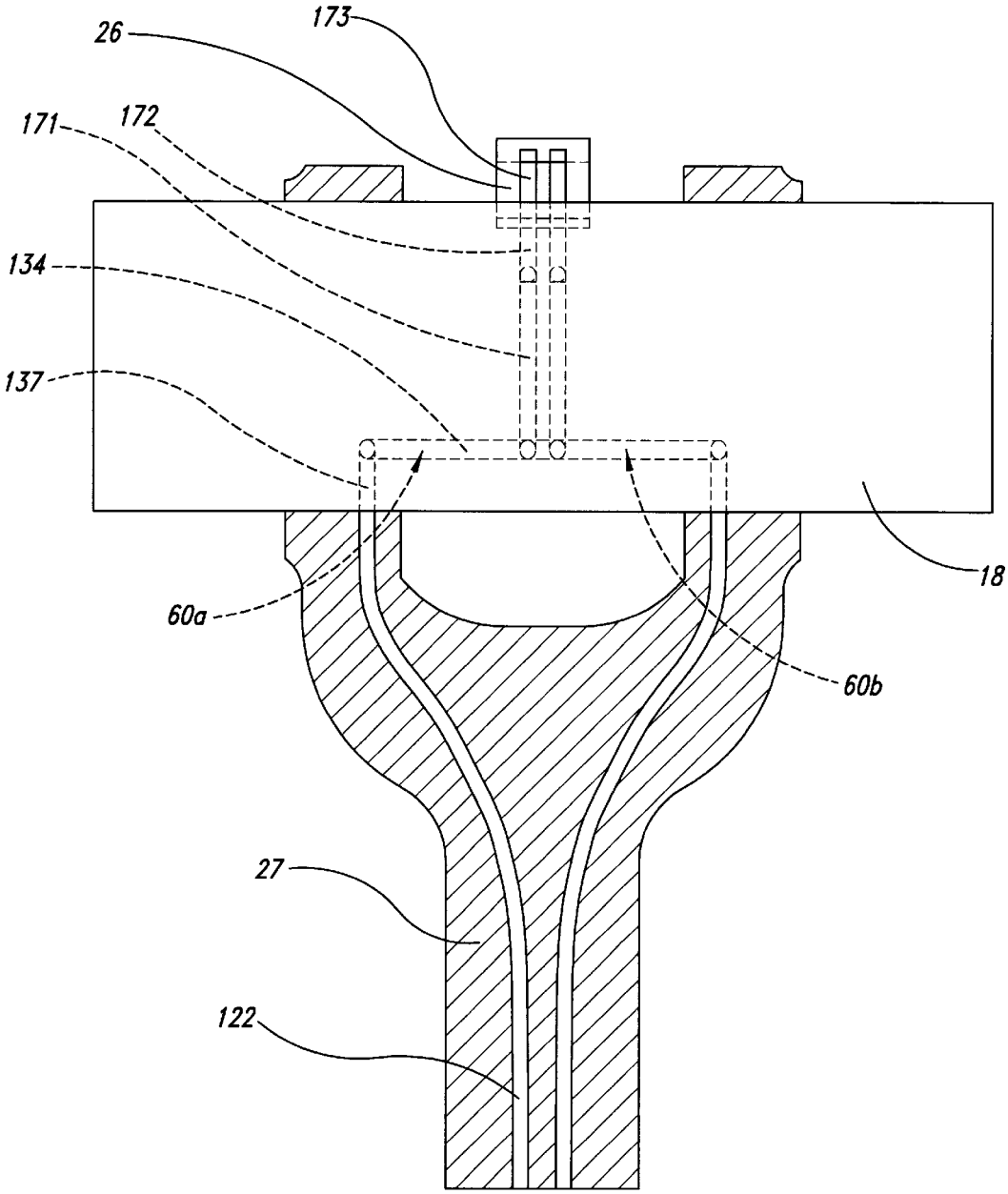
FIG. 13 is a partial cross-sectional view of a connecting rod, a wrist pin and a fluid delivery system of the actuator assembly illustrated in FIG. 12.

A further embodiment of the present invention employs yet another system for actuating the inner piston 11, that is capable of providing either an intermittent or a continuously variable compression ratio. More particularly, as shown in FIG. 12, a plunger type hydraulic piston 135 divides the hydraulic chamber 136 into a first and second region, **136*a* and 136*b*, and the stem 24 has two stem bores 128, 129. Fluid is supplied to bores 128, 129 via two fluid delivery systems 60*a* and 60*b*, respectively. As shown in FIG. 13, each delivery system 60*a* and 60*b* has a connecting rod bore 122, a fluid entry port 137, a fluid supply passage 134, a radial passage 171, a cam bearing surface passage 172, and a piston stem port 173, with fluid delivery system 60*a* in open communication with stem bore 128 and fluid delivery system 60*b* in open communication with stem bore 129**.

The present embodiment dispenses with the coil spring 119, and the restorative force is provided by a hydraulic means. For example, to actuate a low compression ratio mode, a control signal as previously described supplies a volume of fluid via fluid delivery system **60*b* into chamber 136*b*. Fluid in chamber 136*a* is thereby forced out via fluid delivery system 60*a* to a low-pressure source, and a low compression ratio position is attained. To return to a high compression ratio mode, fluid in chamber 136*b* is allowed to exit via the reverse path by which it entered, while pressurized fluid is returned to chamber 136*a*** by the reverse path by which it exited.

A significant advantage of the embodiment shown in FIGS. 12 and 13 is the ability to achieve a multi-stage or continuously variable compression ratio, rather than the discrete two-mode compression ratio variation of the previous embodiments. For example, by directing selected volumes of fluid into chambers 136*a* and 136*b*, balancing forces may be generated on opposite sides of piston 135, such that piston 135 resides in a selected, stable position between the two extreme modes depicted in the Figures. Such a configuration would result in a compression ratio between the high compression ratio mode and low compression ratio mode.

As will be understood by one of ordinary skill, fluid delivery may alternatively be provided to chambers 136*a* and 136*b* by reverting to the single fluid delivery system 60 of FIG. 9 to conduct fluid only to chamber 136*b*, and connecting chambers 136*a* and 136*b* by an external fluid passage, such as a flexible line or other channel, to control flow between chambers 136*a* and 136*b* by a conventionally known valving system.

Figure 14:
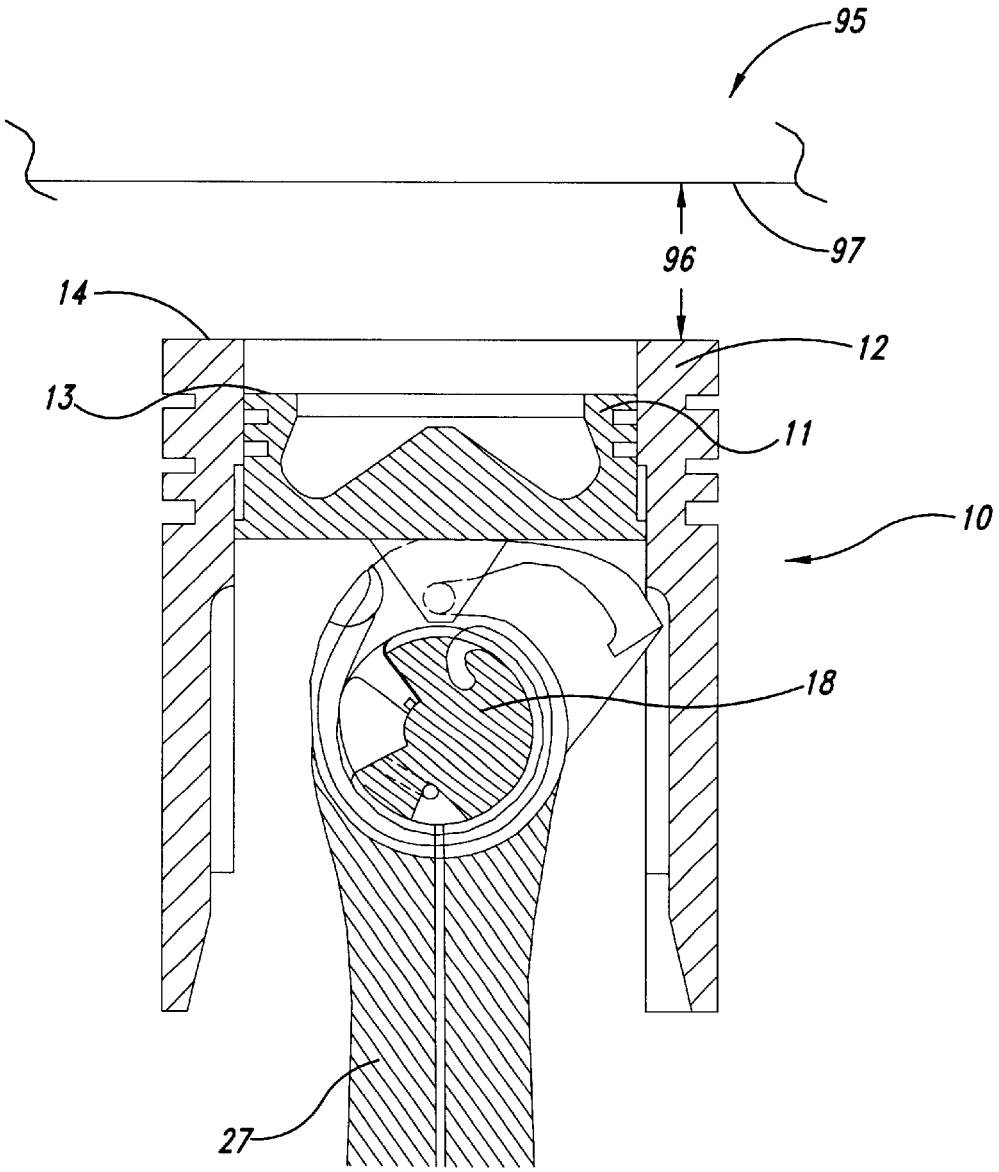
FIG. 14 is a partial cross-sectional view of a piston assembly, provided in accordance with a preferred embodiment of the present invention, illustrated in a top dead center position.

In addition to the numerous advantages achieved by several of the embodiments described above, the present invention also serves to minimize squish variations. Squish area is the volume between the top of a piston at top dead center to the bottom of a cylinder head. Since it is difficult for the fuel or air/fuel mixture to reach this area, a large squish area leads to lower engine efficiencies. Most prior art devices known to vary the compression ratio have the undesired effect of simultaneously varying the squish area by a significant degree. But with the present invention, as is shown in FIG. 14, the distance 96 between the top surface of the outer piston 14 and the bottom surface 97 of a cylinder head 95 when the piston assembly 10 is positioned at top dead center remains substantially constant, independent of the variable location of the inner piston 11.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A piston assembly positionable in an internal combustion engine, the piston assembly comprising:

an outer piston;

an inner piston having a combustion surface;

an actuator coupled to the inner piston; and wherein the inner piston is slidably mounted within the outer piston and selectively moveable by the actuator, and the outer piston and the actuator are directly attached to the wrist pin.

2. A method of generating a variable compression ratio in an internal combustion engine comprising:

selectively sliding an inner piston within an outer piston;

positioning a top surface of the inner piston at a first position;

channeling fluid into an actuator coupled to the inner piston to move the inner piston to a second position wherein the top surface at the second position is lower than the top surface at the first position;

sending a first command signal to a control valve coupled to a fluid source to start a flow of fluid, thereby moving the inner piston to the second position; and sending a second command signal to the control valve to stop the flow of fluid, thereby moving the inner piston to the first position.

3. A piston assembly positionable in an internal combustion engine, the piston assembly comprising an inner piston and an outer piston, the inner piston being slidably mounted within the outer piston and selectively moveable by an actuator comprising a cam coupled to a spring, the spring biasing the inner piston in a first position.

4. A piston assembly positionable in an internal combustion engine, the piston assembly comprising an inner piston and an outer piston, the inner piston being slidably mounted within the outer piston and selectively moveable by an actuator comprising a cam having a plurality of bearing surfaces, the cam being coupled to the inner piston and the inner piston being selectively supported by the bearing surfaces as the cam rotates.

5. A piston assembly positionable in an internal combustion engine, the piston assembly comprising an inner piston and an outer piston, the inner piston being slidably mounted within the outer piston and selectively moveable by a cam coupled to the inner piston and to a hydraulic chamber, a volume of fluid being selectively channeled into the chamber to rotate the cam in a first direction to move the inner piston to a second position and selectively removed from the chamber to rotate the cam in a second direction to allow the inner piston to return to a first position.

6. A piston assembly positionable in an internal combustion engine comprising:

an outer piston;

an inner piston slidably mounted within the outer piston and selectively moveable by an actuator comprising a hydraulic piston provided in a hydraulic chamber and coupled to the inner piston; and a fluid delivery system adapted to be coupled to a fluid source to selectively channel a volume of fluid into the actuator to move the inner piston to a first position and selectively remove the fluid from the actuator to move the inner piston to a second position, the volume of fluid displacing the hydraulic piston to move the inner piston and thereby actuate the inner piston.

7. An apparatus for generating a variable compression ratio in an internal combustion engine comprising:

an outer piston;

an inner piston slidably mounted within the outer piston;

a wrist pin rigidly embedded in the outer piston;

a cam assembly pivotably mounted on the wrist pin and coupled to the inner piston, the cam assembly selectively moving the inner piston to a desired position within the outer piston; and wherein a distance between a top surface of the outer piston and a bottom surface of a cylinder head when the piston assembly is positioned at top dead center remains substantially constant, independent of a location of the inner piston.

8. A method of generating a variable compression ratio in an internal combustion engine comprising:

positioning an inner piston in a first position within an outer piston, the inner and the outer piston being placed within a cylinder of an internal combustion engine, the inner and the outer piston compressing a first volume of air within the cylinder, the first position causing the cylinder to function at a first compression ratio;

selectively moving the inner piston to a second position within the outer piston, the inner and the outer piston compressing a second volume of air within the cylinder, the second position causing the cylinder to function at a second compression ratio; and selectively channeling a volume of fluid into and out of an actuator coupled to the inner piston to move the inner piston.

9. A piston assembly positionable in an internal combustion engine, the piston assembly comprising:

an outer piston;

an inner piston having a combustion surface;

an actuator comprising a cam coupled to a spring; and wherein the actuator is coupled to the inner piston, the inner piston is slidably mounted within the outer piston and selectively moveable by the actuator, and the spring is coupled to the inner piston to bias the inner piston in a first position.

10. The piston assembly according to claim 9 wherein the spring is a clock spring having a first end affixed to a wrist pin, the wrist pin being coupled to the outer piston.

11. The piston assembly according to claim 9 wherein the spring is a coil spring pivotably attached to the cam.

12. A piston assembly positionable in an internal combustion engine, the piston assembly comprising:

an outer piston;

an inner piston having a combustion surface;

an actuator comprising a cam having a plurality of bearing surfaces; and wherein the actuator is coupled to the inner piston the inner piston is slidably mounted within the outer piston and selectively moveable by the actuator, and the inner piston is selectively supported by the bearing surfaces as the cam rotates.

13. The piston assembly according to claim 12 wherein the cam is coupled to a hydraulic chamber, a volume of fluid being selectively channeled into the chamber to rotate the cam in a first direction to move the inner piston to a second position, and selectively removed from the chamber to rotate the cam in a second direction to allow the inner piston to return to a first position.

14. The piston assembly according to claim 13 wherein the cam is further coupled to a spring to bias the inner piston in the first position.

15. A method of generating a variable compression ratio in an internal combustion engine comprising:

positioning an inner piston in a first position within an outer piston, the inner and the outer piston being placed within a cylinder of an internal combustion engine, the inner and the outer piston compressing a first volume of air within the cylinder, the first position causing the cylinder to function at a first compression ratio;

holding the inner piston substantially in the first position;

monitoring operating conditions of the internal combustion engine;

selectively moving the inner piston to a second position within the outer piston at a selected point in time, the inner and the outer piston compressing a second volume of air within the cylinder, the second position causing the cylinder to function at a second compression ratio; and selectively holding the inner piston substantially in the second position.

16. The method according to claim 15 further comprising:

selectively channeling a volume of fluid into and out of an actuator coupled to the inner piston to move the inner piston.

17. The method according to claim 15 further comprising:

monitoring the pressure of the cylinder;

comparing a pressure generated by the inner piston at the first position to a desirable maximum cylinder pressure; and moving the inner piston to change the compression ratio of the cylinder as needed to maximize the compression ratio generated by the engine without exceeding the desired maximum cylinder pressure.

18. The method according to claim 15 further comprising:

monitoring the power demanded;

comparing the power demand to a desirable maximum power output for a compression ratio; and moving the inner piston to change the compression ratio of the cylinder as needed to maximize the compression ratio generated by the engine without exceeding the desired maximum power output.

19. A piston assembly positionable in an internal combustion engine, the piston assembly comprising:

an outer piston; an inner piston having a combustion surface;

an actuator coupled to the inner piston and to a fluid source; and wherein the inner piston is slidably mounted within the outer piston and selectively moveable by the actuator, and a volume of fluid is selectively channeled into the actuator to move the inner piston to a second position and selectively removed from the actuator to allow the inner piston to move to a first position.

20. The piston assembly according to claim 19 wherein a spring is coupled to the inner piston to bias the inner piston to the first position.

21. The piston assembly according to claim 19 wherein a top surface of the inner piston is substantially adjacent to a top surface of the outer piston when the inner piston is in the first position, and below the top surface of the outer piston when the inner piston is in the second position.

22. The piston assembly according to claim 19 wherein a bottom surface of the inner piston rests upon a first flat portion of the actuator when the inner piston is in the first position and upon a second flat portion of the actuator when the inner piston is in the second position.

23. The piston assembly according to claim 19 wherein the actuator is coupled to a connecting rod and the fluid is channeled into the actuator via a fluid delivery system coupled to a bore provided in the connecting rod.

24. The piston assembly according to claim 19 wherein movement of the inner piston is continuously variable.

25. The piston assembly according to claim 19 wherein movement of the inner piston is intermittently variable.

26. The piston assembly according to claim 19 wherein a piston bowl is provided within the inner piston.

27. A piston assembly positionable in an internal combustion engine comprising:

an outer piston;

an inner piston slidably mounted within the outer piston and selectively moveable by an actuator coupled to the inner piston; and a fluid delivery system adapted to be coupled to a fluid source to selectively channel a volume of fluid into the actuator to move the inner piston to a first position and selectively remove the fluid from the actuator to move the inner piston to a second position, thereby actuating the inner piston.

28. The piston assembly according to claim 27 wherein the fluid is engine oil.

29. The piston assembly according to claim 27 wherein the fluid is hydraulic fluid.

30. The piston assembly according to claim 27 wherein the actuator comprises a cam assembly and a hydraulic chamber.

31. The piston assembly according to claim 30 wherein the cam assembly is directly attached to a wrist pin, the wrist pin being integral with the hydraulic chamber and coupled to the outer piston.

32. The piston assembly according to claim 30 wherein the cam assembly is directly attached to a wrist pin and the hydraulic chamber is external to the wrist pin.

33. The piston assembly according to claim 27 wherein the actuator comprises a cam coupled to the inner piston, to a wrist pin and to a connecting rod, the cam being coupled to a hydraulic chamber provided in the wrist pin, and the fluid delivery system includes a bore extending through the connecting rod, the bore being in fluid communication with the hydraulic chamber.

34. The piston assembly according to claim 33 wherein a fluid entry port provided in the wrist pin has a sufficient width to maintain fluid communication with the connecting rod bore as the connecting rod rotates about the wrist pin.

35. The piston assembly according to claim 33 wherein a hydraulic piston coupled to the cam extends into the hydraulic chamber, the volume of fluid selectively flowing into the hydraulic chamber to displace the hydraulic piston to move the cam and the inner piston.

36. The piston assembly according to claim 27 wherein the actuator comprises a hydraulic piston provided in a hydraulic chamber and coupled to the inner piston, the volume of fluid displacing the hydraulic piston to move the inner piston.

37. The piston assembly according to claim 26 wherein the hydraulic piston is provided with a bore to provide a path of fluid communication between the source of fluid and the hydraulic chamber.

38. The piston assembly according to claim 36 wherein the hydraulic chamber has a first region and a second region on either side of a head of the hydraulic piston and a stem having a first bore and a second bore, the first bore being in fluid communication with the first region and the second bore being in fluid communication with the second region.

39. An apparatus for generating a variable compression ratio in an internal combustion engine comprising:

an outer piston;

an inner piston slidably mounted within the outer piston;

a wrist pin rigidly embedded in the outer piston;

a cam assembly pivotably mounted on the wrist pin and coupled to the inner piston;

a control system that monitors operating conditions and selectively generates a command signal; and wherein the cam assembly selectively moves the inner piston to a desired position within the outer piston in response to the command signal.

40. The apparatus according to claim 39 wherein a piston bowl is provided in the inner piston.

41. The apparatus according to claim 39 wherein movement of the inner piston is continuously variable.

42. The apparatus according to claim 39 wherein movement of the inner piston is intermittently variable.

43. The apparatus according to claim 39 wherein a distance between a top surface of the outer piston and a bottom surface of a cylinder head when the piston assembly is positioned at top dead center remains substantially constant, independent of a location of the inner piston.

44. The apparatus according to claim 39 wherein a top surface of the inner piston is substantially adjacent with a top surface of the outer piston when the inner piston is in a first position, and the top surface of the inner piston is below the top surface of the outer piston when the inner piston is in a second position.

45. The apparatus according to claim 39 wherein the cam assembly further comprises a clock spring to bias the inner piston in a first position, the clock spring having a first end affixed to the wrist pin.

46. The apparatus according to claim 39 wherein the cam assembly further comprises a coil spring to bias the inner piston in a first position, the coil spring being pivotably attached to the cam assembly.

47. The apparatus according to claim 39 wherein the cam assembly is coupled to a hydraulic chamber, the hydraulic chamber being coupled to a fluid source and a volume of fluid being selectively channeled into the chamber to actuate the cam assembly to move the inner piston to a second position, the volume of fluid being selectively removed from the chamber to allow the cam assembly and the inner piston to return to a first position.

48. The apparatus according to claim 47 wherein the cam assembly comprises a spring to bias the inner piston in a first position and a hydraulic piston is provided in the hydraulic chamber, displacement of the hydraulic piston actuating the cam assembly.

49. The apparatus according to claim 47 wherein the hydraulic chamber is integral to the wrist pin.

50. The apparatus according to claim 47 wherein the hydraulic chamber is external to the wrist pin.

51. The apparatus according to claim 50 wherein the hydraulic chamber has a first region and a second region on either side of a head of the hydraulic piston and a stem having a first bore and a second bore, the first bore being in fluid communication with the first region and the second bore being in fluid communication with the second region.

52. An internal combustion engine having a variable compression ratio comprising:

an outer piston;

an inner piston slidably mounted within the outer piston;

a wrist pin rigidly embedded in the outer piston;

a cam assembly coupled to the wrist pin and the inner piston to selectively move the inner piston within the outer piston from a first position to a second position; and a fluid delivery system coupled to the cam assembly, wherein a volume of fluid is selectively channeled to and from the cam assembly to move the inner piston from the first position to the second position.

53. The internal combustion engine of claim 52 wherein the fluid is engine oil.

54. The internal combustion engine of claim 52 wherein the fluid is a hydraulic fluid.

55. The internal combustion engine of claim 52 further comprising a spring coupled to the cam assembly to bias the inner piston in the first position.

56. The internal combustion engine of claim 52 further comprising a command signal to activate the flow of fluid to the cam assembly.

57. The internal combustion engine according to claim 52 wherein movement of the inner piston is continuously variable.

58. The internal combustion engine according to claim 52 wherein movement of the inner piston is intermittently variable.

59. The internal combustion engine according to claim 52 wherein a distance between a top surface of the outer piston and a bottom surface of a cylinder head when the outer piston is positioned at top dead center remains substantially constant, independent of a location of the inner piston.

60. The internal combustion engine according to claim 52 wherein a top surface of the inner piston is substantially adjacent with a top surface of the outer piston when the inner piston is in a first position, and the top surface of the inner piston is below the top surface of the outer piston when the inner piston is in a second position.

61. The internal combustion engine according to claim 52 wherein a piston bowl is provided within the inner piston.

* * * * *